US008417136B2

(12) United States Patent
Fujikura et al.

(10) Patent No.: US 8,417,136 B2
(45) Date of Patent: Apr. 9, 2013

(54) IMAGE FORMING APPARATUS, FIXING DEVICE, AND IMAGE FORMING SYSTEM USING THE SAME

(75) Inventors: Teruhiko Fujikura, Hachioji (JP); Toru Kasamatsu, Hachioji (JP); Tadayuki Ueda, Kokubunji (JP); Yoshihito Sasamoto, Hachioji (JP); Satoshi Miyajima, Hino (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 309 days.

(21) Appl. No.: 12/962,171

(22) Filed: Dec. 7, 2010

(65) Prior Publication Data

US 2011/0142468 A1 Jun. 16, 2011

(30) Foreign Application Priority Data

Dec. 11, 2009 (JP) ..... 2009-281314

(51) Int. Cl.
*G03G 15/20* (2006.01)

(52) U.S. Cl. ..... 399/67; 399/122

(58) Field of Classification Search ..... 399/38, 399/67–70, 107, 110, 122, 320, 328; 219/216, 219/619

See application file for complete search history.

(56) References Cited

U.S. PATENT DOCUMENTS

| | | | | |
|---|---|---|---|---|
| 7,212,761 | B2 * | 5/2007 | Sone et al | 399/69 |
| 7,660,554 | B2 * | 2/2010 | Takagi et al. | 399/329 |
| 7,684,745 | B2 * | 3/2010 | Uchida et al. | 399/329 |
| 2008/0124109 | A1 * | 5/2008 | Sone et al. | 399/67 |

FOREIGN PATENT DOCUMENTS

| | | |
|---|---|---|
| JP | 2006-133581 | 5/2006 |

* cited by examiner

*Primary Examiner* — Hoan Tran

(74) *Attorney, Agent, or Firm* — Finnegan, Henderson, Farabow, Garrett & Dunner, L.L.P.

(57) ABSTRACT

Provided are an image forming apparatus, a fixing device, and an image forming system using the same, including: an image forming section for transferring a toner image onto a recording sheet; a first and second fixing rollers for thermally fixing the toner image on the recording sheet; a first and second temperature sensors each provided at a plurality of positions in a longitudinal direction of the fixing roller; and a rocking section for reciprocally shifting at least one of the fixing rollers in the longitudinal direction of the fixing roller, wherein the temperature gradient of each of the fixing rollers is detected, a central position of reciprocal shift of one fixing roller which can be shifted is set such that the temperature gradient of the other fixing roller is cancelled, and then the one fixing roller is reciprocally shifted by the rocking section.

18 Claims, 9 Drawing Sheets

IMAGE FORMING APPARATUS, FIXING DEVICE, AND IMAGE FORMING SYSTEM USING THE SAME

This application is based on Japanese Patent Application No. 2009-281314 filed on Dec. 11, 2009, in Japanese Patent Office, the entire content of which is hereby incorporated by reference.

TECHNICAL FIELD

The present invention relates to image forming apparatuses which forms a toner image by the electrographic method, fixing device for fixing a toner image, and image forming systems provided with the image forming apparatus and the fixing device.

BACKGROUND

In the image forming apparatus using the electrographic method, a toner image is formed on an image carrier of a rotating photoreceptor drum or a photoreceptor belt, the formed toner image is transferred onto a recording sheet directly or indirectly, and the toner image is fixed to form an image.

In the above-mentioned image forming method, the toner image electrostatically transferred onto the recording sheet is stably fixed on the recording sheet by heat and pressure of a fixing roller. The fixing roller surface may be scratched or grooved by the edge of a recording sheet often touching the same part of the fixing roller surface. This situation will cause the problem that the service life of the fixing roller becomes short.

In order to prevent such scratching and grooving, there are measures of shifting the fixing roller in an axial direction. By this shift of the fixing roller, the position at which the edge of a recording sheet touches the fixing roller is varied, and scratches and grooves will be reduced. Whereby, the problem that the service life of the fixing roller is shortened will be resolved.

When the fixing roller is shifted in such a way, the temperature gradient gets large and the temperature distribution on the fixing roller gets uneven due to individual variations of parts and depending on the accuracy variation of assembly, thereby causing insufficient fixing and insufficient gloss of image, resulting in insufficient image quality.

An image forming apparatus employing such a reciprocal shift is proposed following Japanese Laid-Open Patent Application Publication No. 2006-133581 and the like.

In Japanese Laid-Open Patent Application Publication No. 2006-133581, it is determined based on information of temperature whether the location of the recording sheet is appropriate. Thus, the temperature is not actively controlled for the fixing device. Therefore, when the aforementioned situation such as insufficient fixing, insufficient gloss of image, and uneven gloss has occurred, it cannot be surely prevented.

In recent years, there is an image forming apparatus using two fixing devices, a first fixing device and a second fixing device, in order to realize sufficient fixing. In such an image forming apparatus as well, the reduction of the service life due to scratching and grooving on the fixing roller surface is a problem. However, even if the two fixing devices are simply shifted, the imaging quality may be reduced due to a temperature gradient.

SUMMARY

In view of forgoing, one embodiment according to one aspect of the present invention is an image forming apparatus, comprising:

an image forming section configured to form an toner image depending on image data and transfer the toner image onto a recording sheet;

a first fixing roller configured to fix the toner image on the recording sheet by heat;

a first temperature sensor configured to detect temperatures of the first fixing roller at a plurality of positions in a longitudinal direction of the first fixing roller;

a second fixing roller configured to fix the toner image on the recording sheet by heat;

a second temperature sensor configured to detect temperatures of the second fixing roller at a plurality of positions in a longitudinal direction of the second fixing roller, a rocking section configured to reciprocally shift at least one of the first fixing roller and the second fixing roller in a longitudinal direction of the at least one of the rollers; and a controller configured to obtain a first temperature gradient of the first fixing roller and a second temperature gradient of the second fixing roller based on the temperatures detected by the first temperature sensor and the second temperature sensor, set a central position of the reciprocal shift of the at least one of the rollers at a predetermined position so that the first temperature gradient and the second temperature gradient cancel each other, and then control the rocking section to reciprocally shift the at least one of the rollers.

According to another aspect of the present invention, another embodiment is a fixing device which is installed in an imager forming apparatus configured to form a toner image depending on image data and transfer the toner image onto a recording sheet, the fixing device comprising:

a first fixing roller configured to fix the toner image on the recording sheet by heat;

a first temperature sensor configured to detect temperatures of the first fixing roller at a plurality of positions in a longitudinal direction of the first fixing roller, a second fixing roller configured to fix the toner image fixed by the first fixing roller, on the recording sheet by heat;

a second temperature sensor configured to detect temperatures of the second fixing roller at a plurality of positions in a longitudinal direction of the second fixing roller; and a rocking section configured to reciprocally shift at least one of the first fixing roller and the second fixing roller in a longitudinal direction of the at least one of the rollers, wherein a first temperature gradient of the first fixing roller and a second temperature gradient of the second fixing roller are obtained based on the temperatures detected by the first temperature sensor and the second temperature sensor, a central position of the reciprocal shift of the at least one of the rollers is set at a predetermined position so that the first temperature gradient and the second temperature gradient cancel each other, and the rocking section then reciprocally shifts the at least one of the rollers.

According to another aspect of the present invention, another embodiment is an image forming system, comprising:

an image forming device configured to form an toner image depending on image data and transfer the toner image onto a recording sheet; and a fixing device, the fixing device including:

a first fixing roller configured to fix the toner image on the recording sheet by heat;

a first temperature sensor configured to detect temperatures of the first fixing roller at a plurality of positions in a longitudinal direction of the first fixing roller;

a second fixing roller configured to fix the toner image fixed by the first fixing roller, on the recording sheet by heat;

a second temperature sensor configured to detect temperatures of the second fixing roller at a plurality of positions in a longitudinal direction of the second fixing roller; and a rocking section configured to reciprocally shift at least one of the first fixing roller and the second fixing roller in a longitudinal direction of the at least one of the rollers; and wherein the fixing device obtains a first temperature gradient of the first fixing roller and a second temperature gradient of the second fixing roller based on the temperatures detected by the first temperature sensor and the second temperature sensor, and set a central position of the reciprocal shift of the at least one of the rollers at a predetermined position so that the first temperature gradient and the second temperature gradient cancel each other, and the rocking section then reciprocally shifts the at least one of the rollers.

DETAILED DESCRIPTION OF THE PREFERRED EMBODIMENT

With reference to the drawings, an embodiment according to the present invention will be described in detail below.

<Configuration of an Image Forming Apparatus 100>

Figure 1:
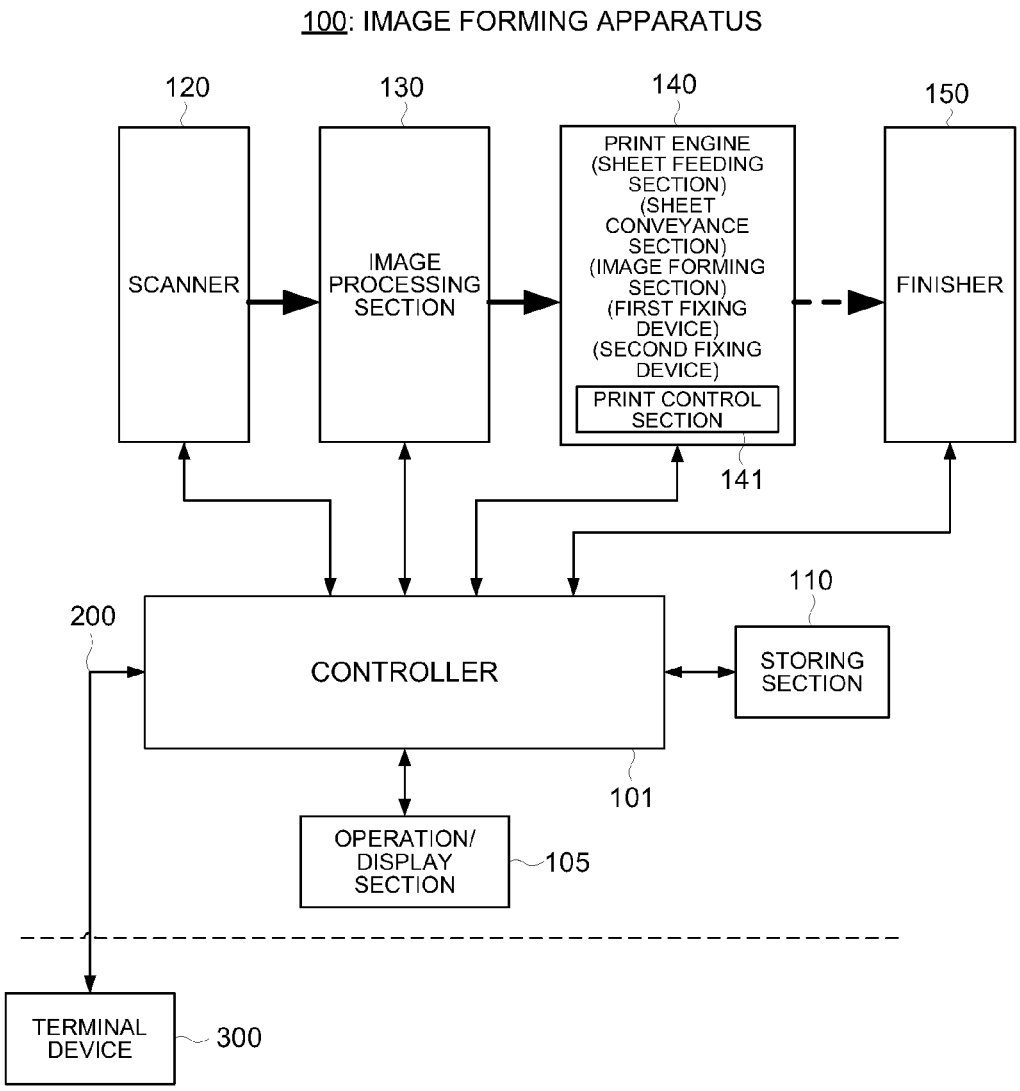
FIG. 1 is a diagram showing a schematic structure of an embodiment according to the present invention.
Figure 2:
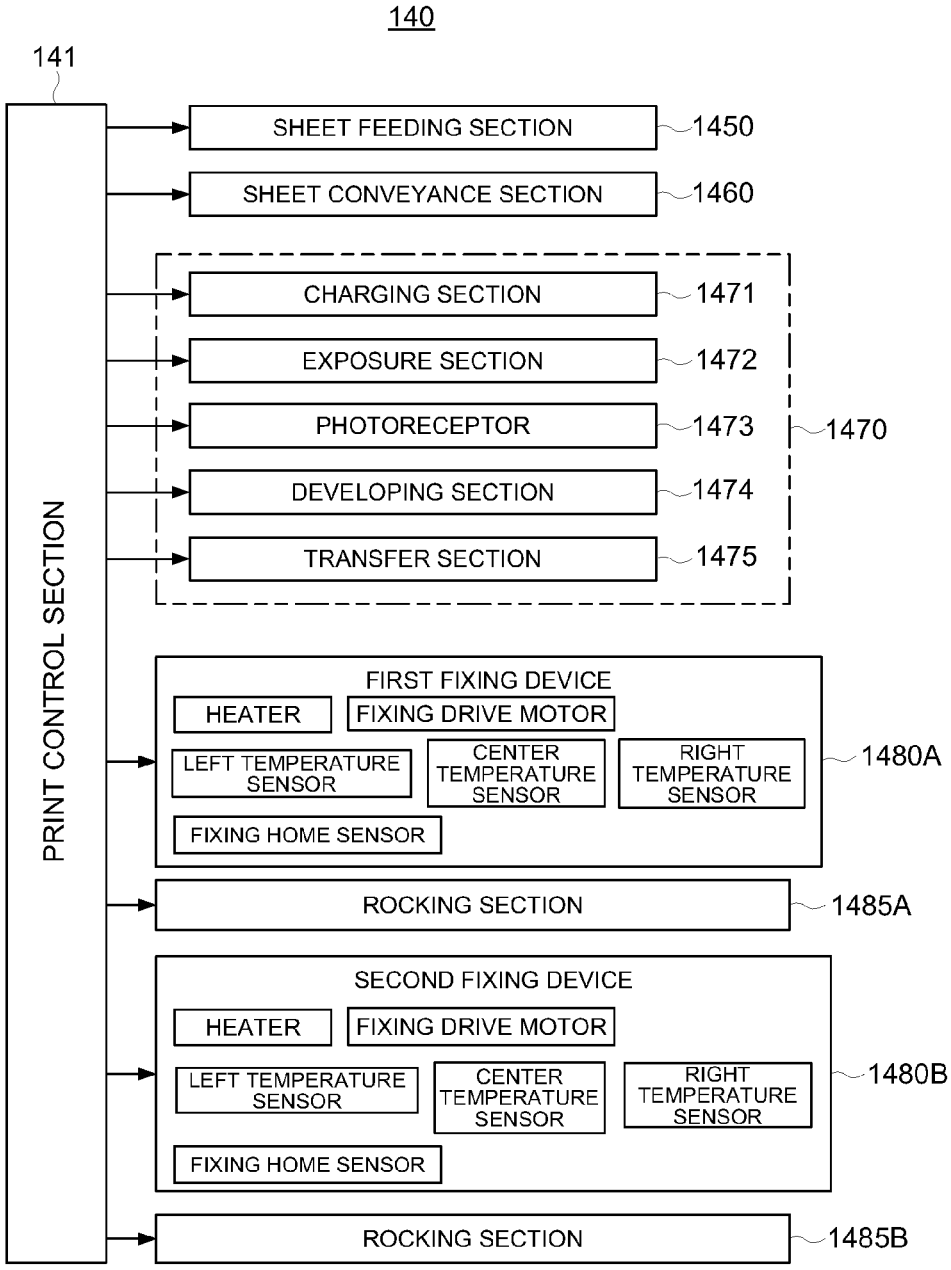
FIG. 2 is a diagram showing a schematic structure of the embodiment according to the present invention.
Figure 3:
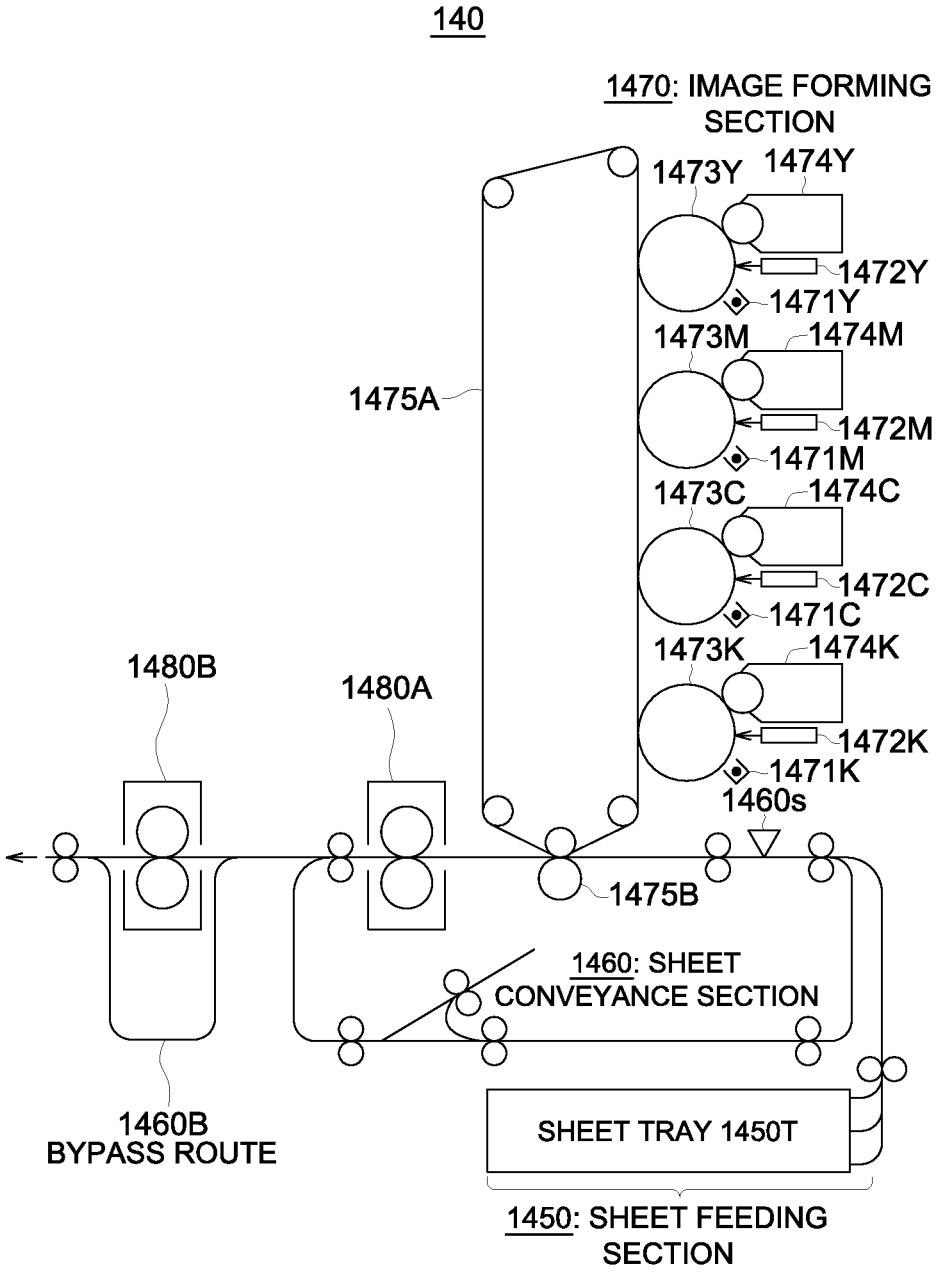
FIG. 3 is a diagram showing a schematic structure of the embodiment according to the present invention.

Here, a configuration of the image forming apparatus 100, using the electrographic method, of the first embodiment is described in detail based on FIGS. 1 to 3. The description is omitted on the general portions of the image forming apparatus 100 which are known and are not directly related to the featured operations or controls of the embodiment.

The image forming apparatus 100 shown in FIG. 1 includes: a controller 101 for controlling respective parts, an operation/display section 105 configured to perform various display and to be used for an operator to input and operate; a storing section 110 for storing job data and various data; a scanner 120 for reading documents to generate image data thereof; an image processing section 130 for performing a predetermined process on the image data to be used for image formation; a print engine 140 for forming an image based on the image data on a recording sheet; and a finisher 150 for performing various post-processing on the sheet on which the image has been formed.

The controller 101 is provided with a CPU (Central Processing Unit), a ROM Read Only Memory), a RAM (Random Access Memory), and the like which are not illustrated. The CPU collectively controls respective portions of the image forming apparatus 100 by executing various programs stored in the ROM, using a predetermined area of the RAM as a working area The Controller 101 performs a shift-fixing control shown in the flowchart, as will be described later.

Here, operation/display section 105 is provided with input devices such as a keyboard, a mouse, and a touch panel, and transmits inputted various instruction signals to the controller 101. The operation/display section 105 is provided with a display device such as an LCD (Liquid Crystal Display) and a CRT (Cathode Ray Tube), and displays the various image data fed from the controller 101. The operation/display section may have an operation section and another indicator separately. However, in the following description the operation/display section 105 is described as a touch panel type, since a touch panel, through which icons and keys (hereinafter, both referred to as a key) are displayed to be pushed down, is widely used.

The storing section 110 is a storage device, such as a HDD (Hard Disc Drive) and a flash memory which are capable of writing, reading, and erasing data, and it can be fixedly provided or detachably provided. The storing section 110 stores job data (including processed job, job under processing, and job to be processed) including registered one or more jobs. The storing section 110 stores the date of replacement of respective parts, and information related to respective parts, for ease of adjustment when replacing parts.

The print engine 140 is an image forming section using the electrographic method or other methods, and is for forming and outputting an image on a predetermined sheet in photocopy machines and fax machines. The print engine 140 has a configuration shown in FIGS. 2 and 3 and is configured with a first fixing device 1480A for fixing a toner image transferred onto a recording sheet with heat and pressure of a fixing roller (first fixing roller) on the recording sheet to be in a stable state, and configured with a second fixing device 1480B for fixing the toner image transferred onto the recording sheet with heat and pressure of a fixing roller (second fixing roller) on the recording sheet to be in a stable state.

A finisher 150 is a post-processing device for performing various post-processings such as stapling, punching, bending, binding, bookbinding, and stacking, on the sheets with images formed thereon.

In the example shown in FIG. 1, the image forming apparatus 100 is communicably connected to a terminal device 300 such as an external PC through a communication section 200. In this embodiment, the communication section 200 is assumed to be a LAN (Local Area Network), a WAN (Wide Area Network), and the like. However, the communication section 200 may be a telephone network, an ISDN (Integrated Services Digital Network) network, an ADSL (Asymmetric Digital Subscriber Line) network, a mobile communications network, a communications satellite line, a CATV (Cable Television) line, an optical communication line, and wireless communications line.

<Configuration of the Print Engine 140>

A configuration of the print engine 140 will be described below in detail with reference to FIG. 2 and the following figures. The description is omitted on general portions of the print engine 140 which are known and are not directly related to the featured operations or control of the embodiment.

Although a configuration only for one color is shown in FIG. 2, a multicolor image forming apparatus is configured with a plurality of portions each for one color as shown in FIG. 3. The print engine 140 of the embodiment is provided with: a print control section 141 made up of a CPU (Central Processing Unit) as a controller for controlling respective portions in relation to image forming; a sheet feeding section 1450 for feeding out a sheet stored in a sheet tray 1450T; a sheet conveyance section 1460 for detecting the sheet fed out by the sheet feeding section 1450 with a sensor 1460*s* and for conveying the sheet at a predetermined speed in synchronism with the image forming; an image forming section 1470 for forming a toner image on a photoreceptor such as a rotating photoreceptor drum and photoreceptor belt, and for directly or indirectly transferring the formed toner image onto the recording sheet to form an image; the first fixing device 1480A for fixing the toner image transferred onto the recording sheet with heat and pressure of the fixing roller on the recording sheet in a stable state; and the second fixing device 1480B for fixing the toner image transferred onto the recording sheet with heat and pressure of a fixing roller (second fixing roller) on the recording sheet in a stable state.

The print control section 141 collectively controls the print engine 140 and the image forming apparatus 100 by controlling respective sections constituting the print engine 140 so as to perform various adjustments and controls, according to control programs of the controller 101 and the image forming apparatus.

The sheet feeding section 1450 is a feeding section which sends out a single or plural recording sheets stored in the sheet tray 1450T to an image formation position, with a feed roller. The sheet conveyance section 1460 is a sheet feeding means which conveys the recording sheet sent out from the sheet feeding section 1450 at a predetermined conveyance speed, and the it is provided with a registration roller, various kinds of conveying, a conveyance belt. In addition, on places of the conveyance section, there are provided in place conveyance sensors 1460*s* such as an edge sensor for sensing the leading edge of a recording sheet. A bypass route 1460B going around the second fixing device 1480B (to be described later) is provided near the second fixing device 1480B, as a detour conveyance route.

The image forming section 1470 is provided with charging sections 1471 (1471Y, 1471M, 1471C, 1471K) for charging photoreceptor drums at a predetermined voltage; exposure sections 1472 (1472Y, 1472M, 1472C, 1472K) for forming electrostatic images on the photo receptors by performing exposure on the charged photoreceptors, in correspondence to image data; photoreceptor drums as image carriers on which the electrostatic images formed by the aforementioned charging and exposure are turned into toner images; developing sections 1474 (1474Y, 1474M, 1474C, 1474K) for attaching toner to the electrostatic images formed on the photoreceptors 1471 (1471Y, 1471M, 1471C, 1471K) to develop them to be toner images; and a transfer section 1475 for electrostatically transferring the toner images formed on the photoreceptors 1473 onto a recording sheet.

Regarding the charging sections 1471, the exposure sections 1472, photoreceptors 1473, they may be independent with respect to each color of YMCK used for image forming as shown in FIG. 3.

The transfer section 1475 may be provided with an intermediate transfer member 1475A which superposes the toner images of respective colors of YMCK, and a secondary transfer section 1475B which transfers the superposed toner images onto a recording sheet.

The toner image transferred on the recording sheet is fixed stably thereon by two fixing devices, a first fixing device 1480A and a second fixing device 1480B. In addition, at least one of the two fixing devices can be reciprocally shifted in the direction of an shaft of a fixing roller by a rocking section 1485A or a rocking section 1485B, as described later.

FIG. 2 shows a concrete example in which two fixing devices, the first fixing device 1480A and the second fixing device 1480B can be shifted in the shaft direction of the fixing roller by the rocking section 1485A and the rocking section 1485B.

<Configuration of the Fixing Device 1480 (the First Fixing Device 1480A and the Second Fixing Device 1480B)>

In the following description, the first fixing device 1480A and the second fixing device 1480B are assumed to have the same configuration, and they are called a fixing device as a whole.

The fixing roller 1481 is heated by a fixing heater, and is rotated by a fixing drive motor (not shown in the figure). The temperature of the first fixing roller is measured by a plurality of temperature sensors including an L (left) temperature sensor 1480SL, a C (center) temperature sensor 1480SC, and an R (right) temperature sensor 1480SR to obtain a gradient of temperature distribution, and the measurement result is communicated to a print control section 141 and a controller 101.

In this application specification, this gradient of temperature distribution is called "temperature gradient". The temperature distribution depends on the state of the fixing roller, and in some cases, the distribution may be even or flat as illustrated in the figure. Even in this case, that temperature distribution is included in a temperature gradient in the following description.

The fixing roller of at least one of the first fixing device 1480A and the second fixing device 1480B is configured to be shifted with respect to the image forming apparatus 100 in the roller shaft direction. In particular, the fixing roller 1481 or the whole fixing device is configured to be shifted in the shaft direction of the fixing roller 1481 by the rocking section 1485 (a rocking motor and a rocking gear driven by the rocking motor), one end of which is fixed to some portion of the image forming apparatus 100. In the figure, the rocking section 1485 is illustrated to have a rocking motor and a rocking gear, but it can be modified in many ways using a voice coil motor, an ultrasonic motor, or a solenoid. Alternatively, the fixing roller 1481 or the whole fixing device may be held by a sliding mechanism (not shown in the figure) for shifting.

The position of the fixing roller 1481 or the whole fixing device being shifted is detected by a swing sensor 1480SH, and the detection result is communicated to the print control section 141 and the controller 101.

Figure 4:
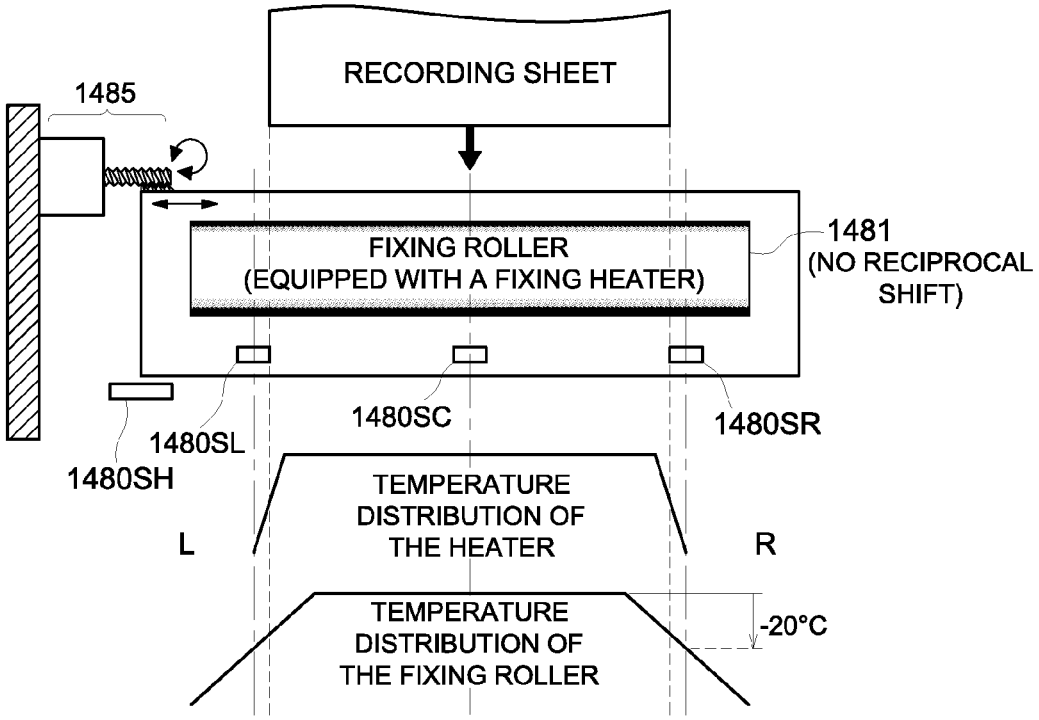
FIG. 4 is a diagram showing a state of a fixing device of the embodiment according to the present invention.

FIG. 4 schematically shows the temperature distributions of the heater and the fixing roller 1481 when the shiftable fixing roller 1481 is not shifted. In this case, assuming the rotation shaft direction of the fixing roller to be in a main scanning direction, the center of the recording sheet in the main scanning direction and the center of the fixing roller in the main scanning direction coincide with each other. The heater built in the fixing roller 1481 has a temperature distribution which is symmetric with respect to the center in the main scanning direction, the fixing roller has a temperature distribution which is flat and decreases in the both end portions.

Figure 5:
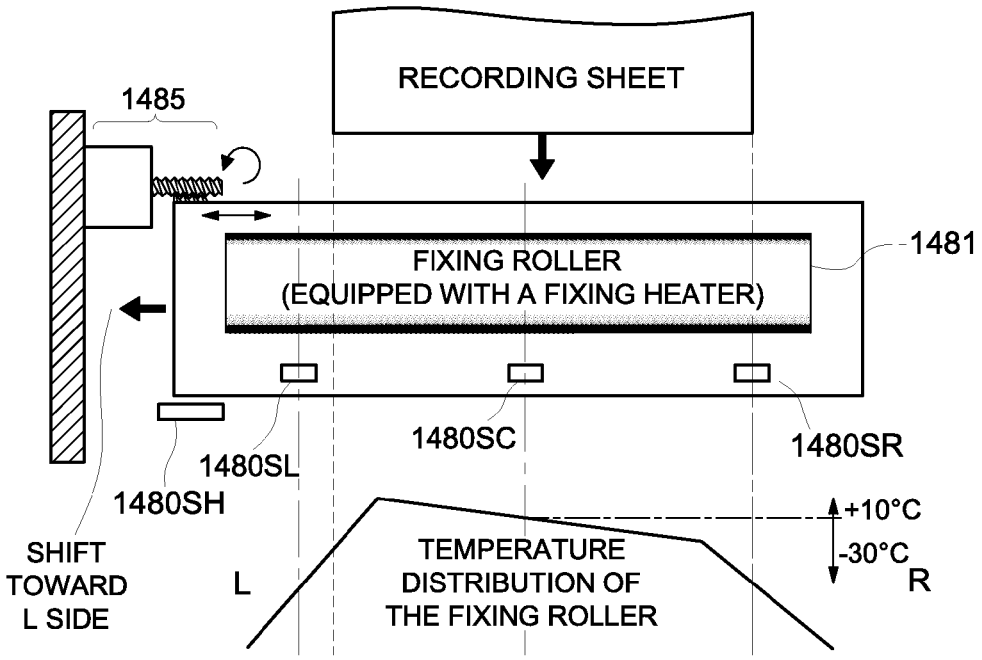
FIG. 5 is a diagram showing a state of the fixing device of the embodiment according to the present invention.

In this configuration, even in the both end portions of the recording sheet, the temperature is kept within a predetermined range (for example, the temperature in the flat part −20° C.), and the stable fixing is thus performed. On the other hand, when the fixing roller 1481 is shifted toward the L side in the main scanning direction as shown in FIG. 5, the relative position between the fixing roller 1481 and the recording sheet is changed, which situation causes the decrease in heat radiation on the L side of the fixing roller (in the vicinity of the L temperature sensor 1480SL) and the increase in heat radiation on the R side of the fixing roller 1481 (in the vicinity of the L temperature sensor 1480SR). As a result, as shown in FIG. 5, the temperature distribution of the fixing roller has a high temperature portion on the L side and a low temperature portion on the R side. For example, with respect to the vicinity of the center, the temperature on the L side is raised by 10° C., and that on the R side is lowered by 30° C. To the contrary, the direction of the shift is toward the R side, the temperature gradient is reversed.

The magnitude of this temperature gradient depends on the amplitude of the shift. In particular, when the shift is made larger toward the L side, the temperature on the L side is accordingly raised, and that on the R side is accordingly lowered, resulting in a larger temperature gradient. To the contrary, when the shift toward the L side in FIG. 5 is made smaller, the temperature rise on the L side is made smaller, and the temperature fall on the R side is made smaller, resulting in a gentle temperature gradient. Consequently, the direction of the temperature gradient depends on the direction of the shift, and the temperature gradient can be controlled by controlling the amplitude of the shift.

Figure 6A:
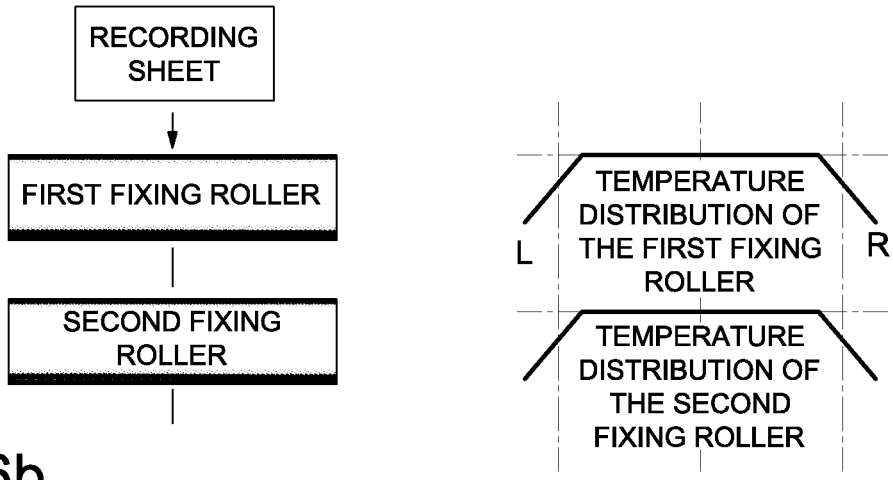
FIGS. 6*a*, 6*b*, and 6*c* are diagrams showing a state of the fixing device of the embodiment according to the present invention.
Figure 6B:
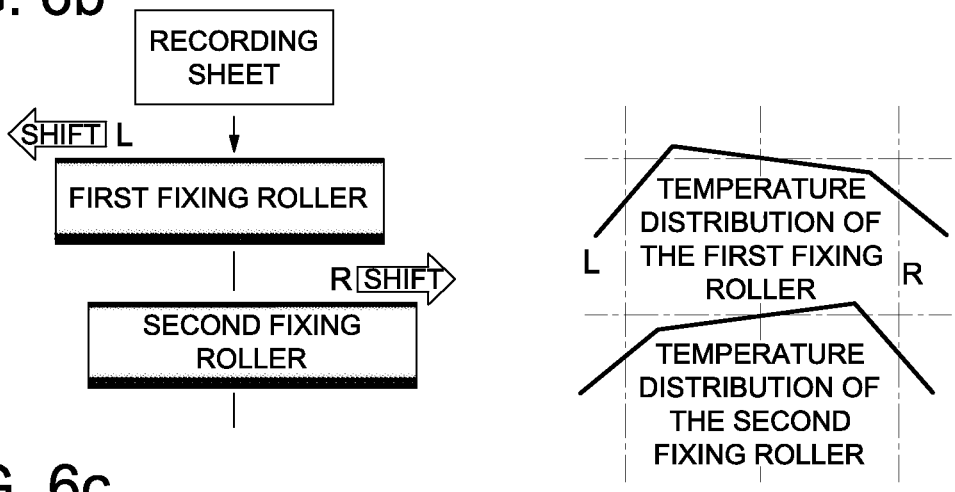
Figure 6C:
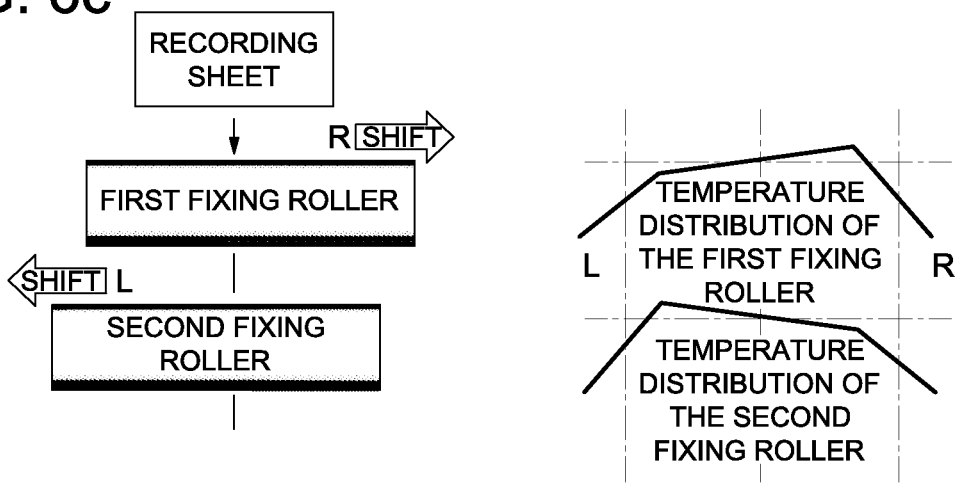

FIGS. 6*a*, 6*b*, and 6*c* shows the relationship between the shift and the temperature distribution of the fixing roller, in the case that the first fixing roller 1481A and the second fixing roller 1481B are both able to be shifted. FIG. 6*a* shows the first fixing roller 1481A and the second fixing roller 1481B both not being shifted and being located at the center. In this situation, as shown in FIG. 6*a*, the first fixing roller 1481A and the second fixing roller 1481B both have a flat temperature distribution, and the superposed temperature distribution of the two are still flat.

FIG. 6*b* shows the first fixing roller 1481A shifted toward the L side and the second fixing roller 1481B shifted toward the R side. In this situation, as shown in FIG. 6*b*, the temperature distribution of the first fixing roller 1481A is higher on the L side and lower on the R side, and the temperature distribution of the second fixing roller 1481B is lower on the R side and higher on the R side. Thus, superposing the temperature gradients of the two fixing rollers makes a flat temperature distribution.

FIG. 6*c* shows the first fixing roller 1481A shifted toward the R side and the second fixing roller 1481B shifted toward the L side. In this situation, as shown in FIG. 6*c*, the temperature distribution of the first fixing roller 1481A is lower on the L side and higher on the R side, and the temperature distribution of the second fixing roller 1481B is higher on the L side and lower on the R side. Thus, superposing the temperature gradients of the two fixing rollers makes a flat temperature distribution.

FIGS. 6*a*, 6*b*, and 6*c* show the case where the opposite temperature gradients are the same, and thus superposing the temperature gradients of the two fixing rollers makes a flat temperature distribution. However, there may be a case where the temperature gradients are not cancelled, even if the opposite temperature gradients are actually superposed. Such a case will be described below with reference to FIGS. 7*a*, 7*b*, and 7*c*.

Figure 7A:
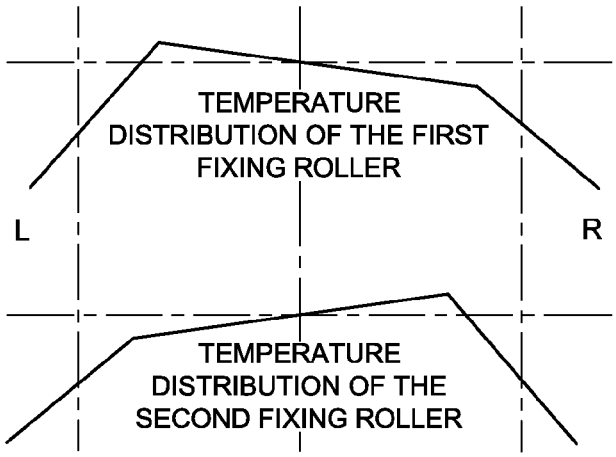
FIGS. 7*a*, 7*b*, and 7*c* are diagrams showing a state of the fixing device of the embodiment according to the present invention.

FIG. 7*a* shows the temperature distribution of the first fixing roller 1481A in which the L side is higher and the R side is lower, and the temperature distribution of the second fixing roller 1481B in which the L side is lower and the R side is higher. The two fixing rollers have the temperature gradients which are opposite but approximately identical. Superposing the temperature gradients of the two fixing roller makes a flat temperature distribution.

Figure 7B:
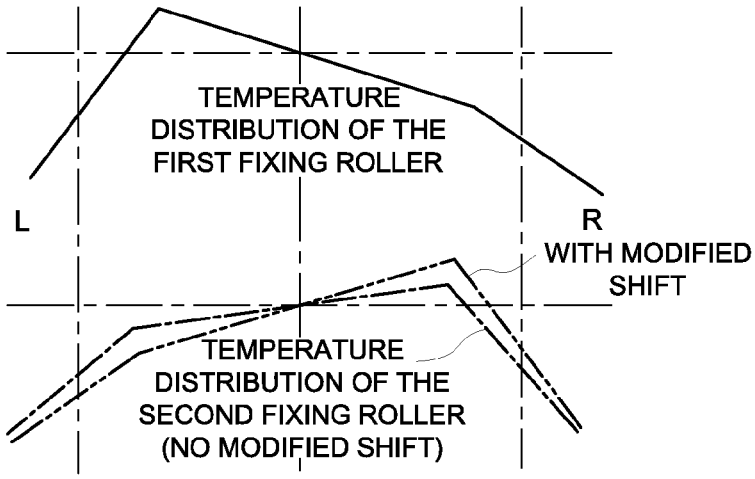

On the other hand, FIG. 7*b* shows the temperature distribution of the first fixing roller 1481A in which the L side is higher and the R side is low, and the temperature distribution of the second fixing roller 1481B in which the L side is lower and the R side is higher. The temperature gradient of the second fixing roller 1481B is gentler than the temperature gradient of the first fixing roller 1481A (see the solid line in FIG. 7*b*). Thus, even if the temperature gradients of the two fixing rollers are superposed as they are, a flat temperature distribution is not obtained. For this reason, the second fixing roller 1481B is shifted further toward the R side, whereby the L side temperature is further lowered and the R side temperature is further raised as shown by the two-dot chain line of FIG. 7*b*. Thus, its gradient gets closer to that of the first fixing roller 1481A. As a result, the two fixing rollers have the temperature gradients which are opposite but approximately identical. Thus, superposing the temperature gradients of the two fixing rollers makes a flat temperature distribution.

Figure 7C:
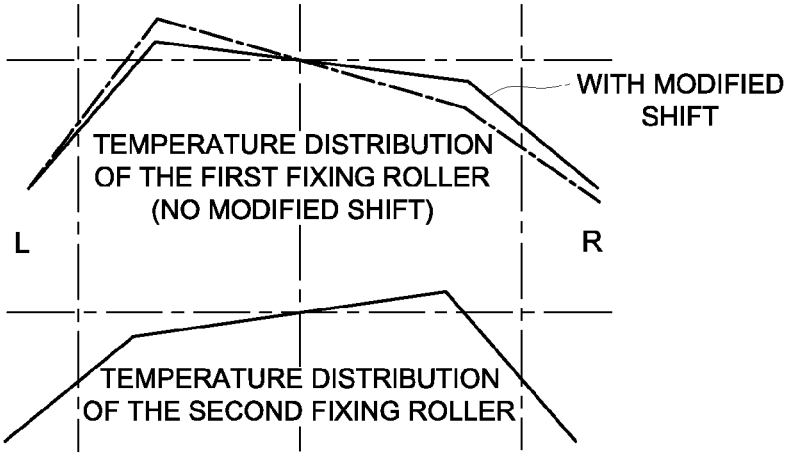

Alternatively, as shown in FIG. 7*c*, the shift toward the L side of the first fixing roller 1481A can be reduced to ease the temperature gradient of the first fixing roller 1481A (see the chain line of FIG. 7*c*), thereby bringing it close to the temperature gradient of the second fixing roller 1481B (see the solid line of FIG. 7*c*). In this manner, the temperature gradients of the two fixing rollers are opposite but approximately identical. Thus, superposing the temperature gradients of the two fixing rollers makes a flat temperature distribution.

Alternatively, both of the manners of FIG. 7*b* and FIG. 7*c* may be used to bring the temperature gradients of the two fixing rollers close to each other, and then, the temperature gradients of the two fixing rollers may be superposed, thereby obtaining a flat temperature distribution.

<Operation>

With reference to the flow charts of FIGS. 8 and 9, the operations of the image forming apparatus, the fixing device, and the image forming system of the present embodiment are described below.

In the following, description will be made on the case that both of the first fixing roller 1481A and the second fixing roller 1481B can be shifted. When the image forming is started, the instruction to start image forming is given from the controller 101, and according to the instruction, the first fixing roller 1481A and the second fixing roller 1481B are controlled by a not-shown typical fixing control method to rotate while they are temperature-controlled to be a predetermined temperature. In addition, the print control section 141 controls the rocking section 1485A and the rocking section 1485B to start reciprocal shift of the first fixing roller 1481A and the second fixing roller 1481B with a predetermine phase difference and a predetermined amplitude at a predetermined cycle, as shown in FIGS. 6*a*, 6*b*, and 6*c* and so on (step S101 of FIG. 8).

In the mean time, it is preferable that the print control section 141 checks whether the first fixing roller 1481A and the second fixing roller 1481B are reciprocally driven with the predetermined phase difference and the predetermined amplitude, based on the detection result of the swing sensor 1480SH. In this case, although depending on the performance of the image forming apparatus 100, the print control section 141 may control the rocking section 1485A and the rocking section 1485B to perform a reciprocal shift by millimeters to tens of millimeters, for example, every image forming of tens or hundreds of recording sheets.

Figure 8:
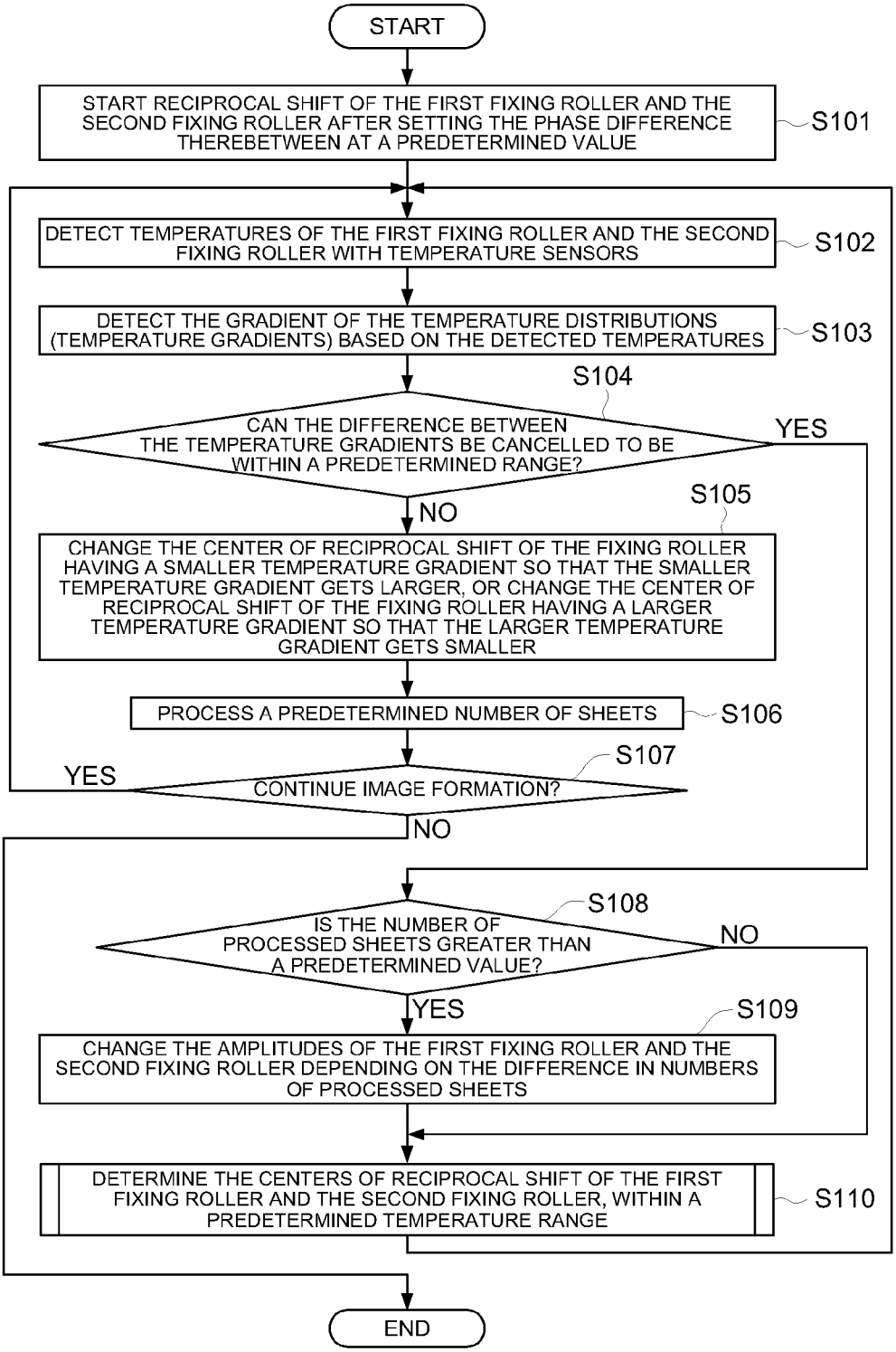
FIG. 8 is a flowchart of an operation of the embodiment according to the present invention.

At that time, the print control section 141 detects the temperatures of the first fixing roller 1481A and the second fixing roller 1481B with a plurality of temperature sensors including the L temperature sensor 1480SL, the C temperature sensor 1480SC, and the R temperature sensor 1480SR which are arranged at a predetermined positions in a vicinity of each fixing roller surface (step S102 of FIG. 8), thereby detecting the distributions of temperature (temperature gradients) of the first fixing roller 1481A and the second fixing roller 1481B (step S103 of FIG. 8).

The print control section 141 judges whether the difference between the detected temperature gradients of the first detected fixing roller 1481A and the second fixing roller 1481B can be cancelled to be within a predetermined range (step s104, of FIG. 8). Here, "to be cancelled" means that the two temperature gradients are in different direction and the unevenness of the superposed temperature distribution is within a predetermined range (+10° C. to −20° C., for example).

If the difference between the detected temperature gradients of the first fixing roller 1481A and the second fixing roller 1481B is not expected to be cancelled to be within the predetermined range (step S104 of FIG. 8, No), the print control section 141 controls the rocking section 1485A and the rocking section 1485B in the following manner as shown in FIGS. 7*b* and 7*c* (Step S105 in drawings 8): the center of the fixing roller having a smaller temperature gradient is shifted so as to increase the temperature gradient, and the center of the fixing roller having a larger temperature gradient is shifted so as to decrease the temperature gradient.

When continuing the image formation, after image formation of a predetermined volume of recording sheets or image formation for a predetermined time period (steps S106 and S107 of FIG. 8), the print control section 141 repeats the aforementioned detection of temperatures of the fixing rollers (step S102 of FIG. 8), detection of the temperature gradients (step S103 of FIG. 8), judgment of the cancelation of temperature gradients (step S104), and shifting of the reciprocal shift center in the case of existing of temperature gradient (step S105 of FIG. 8).

Due to these controls, the temperature gradients of the two fixing rollers are in different directions and have an approximately identical gradient, whereby the two temperature gradients makes a flat temperature distribution being superposed on each other.

As described above, in the case of using two fixing devices to perform thermal fixing, since the position of the roller with which the recording sheet is in contact is varied due to the shift of the two rollers, the service life of the fixing rollers are improved without causing reduction in image quality due to temperature gradient.

In addition, the print control section 141 checks whether the difference in the numbers of processed sheets between the first fixing device 1480A and the second fixing device 1480B is more than a predetermined number (step S108 of FIG. 8).

When performing two-side image formation, a recording sheet goes through the first fixing device 1480A twice. A recording sheet goes through the second fixing device 1480B only once for any of one-side image formation and two-side image formation. Therefore, the number of processed sheets of the first fixing device 1480A may increase more than the number of processed sheets of the second fixing device 1480B.

In addition, when a thinner recording sheet is used, since appropriate fixing is done by going through only the first fixing device 1480A, the sheet goes through the bypass route 1460B instead of the second fixing device 1480B. With this arrangement, the number of processed sheets may be more in the first fixing device 1480A than in the second fixing device 1480B.

For this reason, the first fixing device 1480A may be affected, for example, being scratched by a sheet edge, more than the second fixing device 1480B.

For this reason, if the difference in the numbers of processed sheets between the first fixing device 1480A and the second fixing device 1480B is more than the predetermined number (step S108 of FIG. 8, Yes), the print control section 141 sets the amplitude of shift for the first fixing roller 1481A, which has the increased number of processed sheets, to be greater than that for the second fixing roller 1481B (step S109 of FIG. 8).

As described above, a greater amplitude of shill makes a greater temperature gradient. Therefore, the print control section 141 sets the amplitude of shift for the first fixing roller 1481A to be greater than that for the second fixing roller 1481B to the extent that the difference between the temperature gradients of the first fixing roller 1481A and the second fixing roller 1481B are cancelled to be in a predetermined range (step S109 of FIG. 8).

With this arrangement, the first fixing roller 1481A, which has the greater number of processed sheets, contacts with the recording sheet edge at a wider area than the second fixing roller 1481B, thereby reducing scratches and grooves. Thus, the issue that the difference between the service lives is caused depending on the difference in the numbers of processed sheets is reduced.

In addition, it is preferable that the print control section 141 calculates the remnant lives of the first fixing roller 1481A and the second fixing roller 1481B, referring to the last part replacement times and the numbers of processed sheets, and it controls to increase the amplitude of shift for the fixing roller having a shorter remnant life, if it can be shifted. These controls prolong the service life of the one having a shorter remnant life as much as possible.

In addition, the print control section 141 controls the center position of the reciprocal shift for each of the first fixing roller 1481A and the second fixing roller 1481B in such a manner that the surface temperature of the fixing roller is within a preferable predetermined temperature range, for example, m ° C. to n ° C., and it then performs a reciprocal shift center position control and a reciprocal shift amplitude control so as to shift with a maximum amplitude of shift within that temperature range (step S110 of FIG. 8). The control at step S110 of FIG. 8 will be described in detail with reference to FIG. 9.

Since the control described below is equally performed on both of the first fixing device 1480A and the second fixing device 1480B, description will be made without distinguishing the first and the second. The print control section 141 detects the temperatures of the first fixing roller 1481A and the second fixing roller 1481B with a plurality of temperature sensors including the L temperature sensor 1480SL, the C temperature sensor 1480SC, and the R temperature sensor 1480SR which are arranged at predetermined positions in a vicinity of each fixing roller surface (step S201 of FIG. 9)

First, regarding the detection temperature TR obtained by the R temperature sensor 1480SR, it is judged which of the following relationships it satisfies: $TR>n$, $TR<m$, and $n \geqq TR \geqq m$ (step S202 of FIG. 9).

If the detection temperature TR obtained by the R temperature sensor 1480SR is $n \geqq R \geqq m$ (step S203 of FIG. 8, $n \geqq TR \geqq m$), it is judged which of the following relationships the detection temperature TL obtained by L temperature sensor 1480SL satisfies: $TL>n$, $TL<m$, and $n \geqq TL \geqq m$ (step S203 of FIG. 9).

Figure 9:
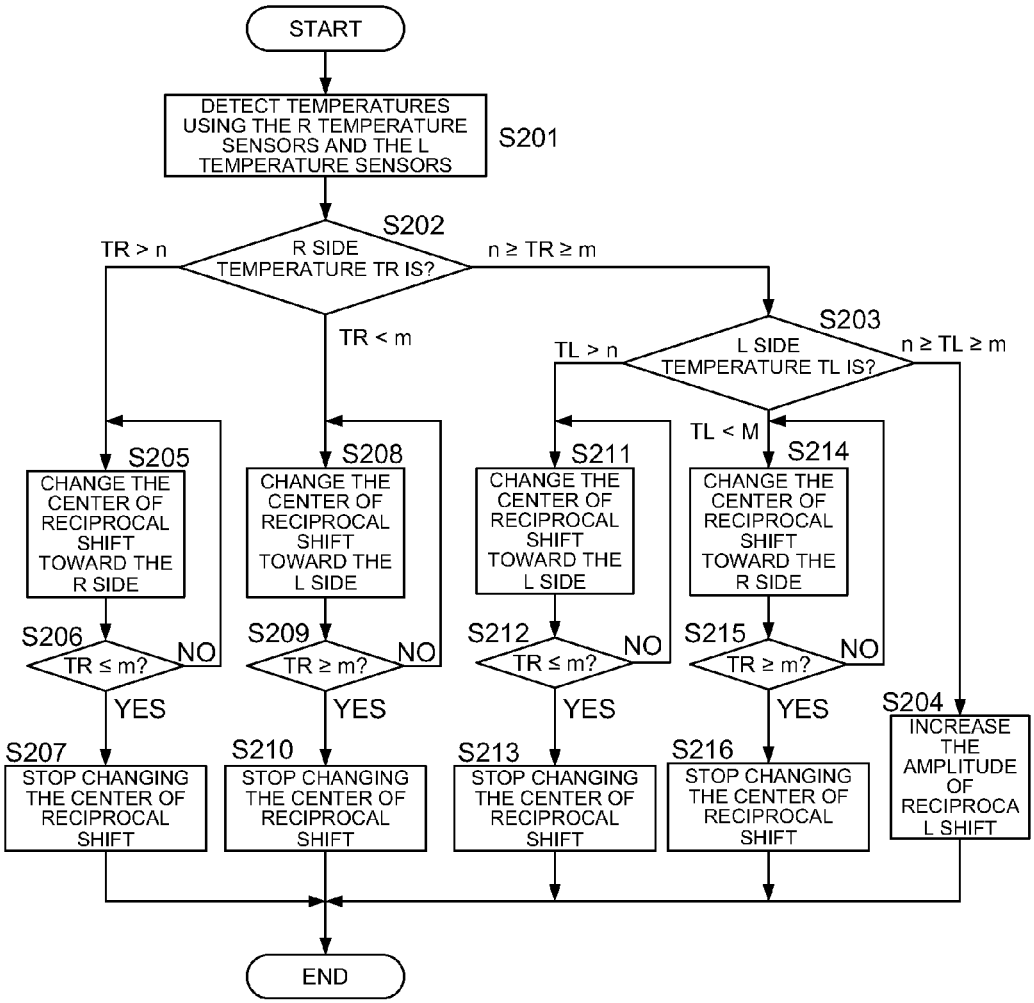
FIG. 9 is a flowchart of an operation of the embodiment according to the present invention.

If the detection temperature TL obtained by the L temperature sensor 1480SL satisfies the relationship $n \geqq TL \geqq m$ (step S203 of FIG. 9, $n \geqq TL \geqq m$), it means that both of the L side and the R side are in the preferable temperature range m ° C. to n ° C., and the print control section 141 controls the rocking section 1485 so as to increase the amplitude of shift by a predetermined amount, for example, 1 mm (step S204 of FIG. 9).

Instead, the detection temperature TR obtained by the R temperature sensor 1480SR satisfies the relationship TR>n (step S202, TR>n), it means that the R side exceeds the preferable temperature range n ° C., therefore, the print control section 141 controls the rocking section 1485 so as to move the center of reciprocal shift of the fixing roller 1481 toward the L side by a small amount (step S205 of FIG. 9).

In this case, the appropriate center of reciprocal shift only has to be gradually obtained by repeating the temperature detection and the movement of the central position, and the amount of the slight movement may be 1 mm or approximately a tenth of the current shift amount of the center of reciprocal shift.

Then, the movement of the center of reciprocal shift toward the L side is continued until the detection temperature TR obtained by the R temperature sensor 1480SR becomes n or lower (steps S205 and S206 of FIG. 9), and when the detection temperature TR obtained by the R temperature sensor 1480SR becomes n or lower, the movement of the center of reciprocal shift is stopped (step S206 of FIG. 9, Yes and step S207).

Instead, the detection temperature TR obtained by the R temperature sensor 1480SR satisfies the relationship TR<m (step S202, TR<m), it means that the R side is lower than the preferable temperature range m ° C., therefore, the print control section 141 controls the rocking section 1485 so as to move the center of reciprocal shift of the fixing roller 1481 toward the R side by a small amount (step S208 of FIG. 9).

In this case, the appropriate center of reciprocal shift only has to be gradually obtained by repeating the temperature detection and the movement of the central position, and the amount of the slight movement may be 1 mm or approximately a tenth of the current shift amount of the center of reciprocal shift.

Then, the movement of the center of reciprocal shift toward the R side is continued until the detection temperature TR obtained by the R temperature sensor 1480SR becomes m or higher (steps S208 and S209 of FIG. 9), and when the detection temperature TR obtained by the R temperature sensor 1480SR becomes m or higher, the movement of the center of reciprocal shift is stopped (step S209 of FIG. 9, Yes and step S210).

Instead, the detection temperature TL obtained by the L temperature sensor 1480SL satisfies the relationship TL>n (step S203, TL>n), it means that the L side exceeds the preferable temperature range n ° C., therefore, the print control section 141 controls the rocking section 1485 so as to move the center of reciprocal shift of the fixing roller 1481 toward the R side by a small amount (step S211 of FIG. 9).

In this case, the appropriate center of reciprocal shift only has to be gradually obtained by repeating the temperature detection and the movement of the central position, and the amount of the slight movement may be 1 mm or approximately a tenth of the current shift amount of the center of reciprocal shift.

Then, the movement of the center of reciprocal shift toward the R side is continued until the detection temperature TL obtained by the L temperature sensor 1480SL becomes nor lower (steps S211 and S212 of FIG. 9), and when the detection temperature TL obtained by the L temperature sensor 1480SL becomes n or lower, the movement of the center of reciprocal shift is stopped (step S212 of FIG. 9, Yes and step S213).

Instead, the detection temperature TL obtained by the L temperature sensor 1480SL satisfies the relationship TL<m (step S203, TL<m), it means that the L side is lower than the preferable temperature range m ° C., therefore, the print control section 141 controls the rocking section 1485 so as to move the center of reciprocal shift of the fixing roller 1481 toward the L side by a small amount (step S214 of FIG. 9).

In this case, the appropriate center of reciprocal shift only has to be gradually obtained by repeating the temperature detection and the movement of the central position, and the amount of the slight movement may be 1 mm or approximately a tenth of the current shift amount of the center of reciprocal shift.

Then, the movement of the center of reciprocal shift toward the L side is continued until the detection temperature TL obtained by the L temperature sensor 1480SL becomes m or higher (steps S214 and S215 of FIG. 9), and when the detection temperature TL obtained by the L temperature sensor 1480SL becomes m or higher, the movement of the center of reciprocal shift is stopped (step S215 of FIG. 9, Yes and step S216).

With the above mentioned arrangement, the print control section 141 controls the center position of the reciprocal shift for each of the first fixing roller 1481A and the second fixing roller 1481B in such a manner that the surface temperature of the fixing roller is within a preferable predetermined temperature range, for example, m ° C. to n ° C., and it then performs a reciprocal shift center position control and a reciprocal shift amplitude control so as to shift with a maximum amplitude of shift within that temperature range, thereby obtaining the maximum amplitude of reciprocal shift without causing reduction in image quality due to temperature change and prolonging the service life of the fixing roller.

<Other Embodiment 1>

In the above description of the embodiment, it is assumed that both the first fixing roller 1481A and the second fixing roller 1481B can be shifted.

However, in some configurations of the image forming apparatus 100, only one of the fixing rollers may be shifted. In that configuration, the print control section 141 is configured to detect the temperature gradient of the fixing roller which cannot be shifted and set the central position of reciprocal shift of the fixing roller which can be shifted so as to cancel the detected temperature gradient. In addition, the print control section 141 controls the rocking section 1485 to shift the fixing roller with a certain amplitude of reciprocal shift such that the temperatures of the both sides of the temperature distribution are kept in a preferable temperature range. With this manner, in the case of using two fixing devices to perform thermal fixing, the service life of the fixing roller is improved without causing reduction in image quality due to a temperature gradient by employing reciprocal shift.

In addition, if the fixing roller having processed the greater number of recording sheets can be shifted, the print control section 141 may instruct the rocking section 1485 to shift that roller. Similarly, if the fixing roller having a shorter remnant life can be shifted, the print control section 141 may instruct the rocking section 1485 to shift that roller. In this case, the maximum amplitude of reciprocal shift can be obtained without causing reduction in image quality due to temperature change, thereby prolonging the service life of the fixing roller as much as possible.

<Other Embodiment 2>

In the above description of the embodiments, although the image forming apparatus 100 is assumed to have both the first fixing device 1480A and the second fixing device 1480B, it is not limited thereto.

For example, an image forming apparatus having no fixing device may be externally provided with a first fixing device 1480A and a second fixing device 1480B. In that case, a controller of either of the image forming apparatus or an external fixing device may perform the above-described control.

Instead, an image forming apparatus having only a first fixing device 1480A may be externally provided with a second fixing device 1480BA. In that case, the controller provided in either of the image forming apparatus or the external second fixing devices 1480B may perform the above-described control.

In addition, in an image forming system made up of the image forming apparatus, or the image forming apparatus and an external fixing device, any one of the control sections may perform the above-described control.

<Other Embodiment 3>

In the above description of the embodiments, in the case that the first fixing roller 1481A and the second fixing roller 1481B already have opposite temperature gradients, the center of reciprocal shift is further shifted so as to cancel the gradients. However, when the first fixing roller 1481A and the second fixing roller 1481B already have opposite temperature gradients, control may be conducted so as not to further shift the center of reciprocal shift, if need be.

<Other Embodiment 4>

In the above description of the embodiments, although the image forming apparatus 100 is assumed to have both the first fixing device 1480A and the second fixing device 1480B, it is not limited thereto. The control of reciprocal shift may be conducted as described above even for an image forming apparatus and a fixing device provided with three or more fixing devices such as a first fixing device 1480A, a second fixing device 1480B, and a third fixing device.

<Other Embodiment 5>

In the above description of the embodiments, although the four-color image forming apparatus of FIG. 2 is described as a concrete example, these embodiments may be applied to other black and white image forming apparatus and an image forming apparatus using more than four color materials.

<Other Embodiment 6>

Although the fixing device for thermally fixing toner images formed by the electrophotographic method is described as a concrete example, the embodiments are not limited thereto. For example, the above-described embodiments may be applied to image forming apparatuses, fixing devices, and image forming systems for thermally fixing images formed with other material than toner, and an excellent result can be obtained <Other Embodiment 7>

In the above description of the embodiments, the names of "first" and "second" such as the first fixing device, the first fixing roller, the second fixing device, and the second fixing roller are used just for ease of description. Therefore, when applying the technologies of the above-described embodiments to obtain advantages, which one should be named "first" or "second" and "first" is arbitrarily determined in individual image forming apparatus, fixing device, and image forming system.

According to the above-described embodiments, the following advantages can be obtained.

(1) By reciprocally shifting a fixing roller, the service life of the fixing roller is improved without causing reduction in image quality due to a temperature gradient, where the gradient of temperature distribution (temperature gradient) of each of the first fixing roller and the second fixing roller is detected, the central position of the reciprocal shift of one fixing roller which can be shifted is set such that the temperature gradient of the other fixing roller is cancelled, and then the one fixing roller is reciprocally shifted by a rocking section.

(2) By reciprocally shifting two fixing rollers, the service life of the fixing roller is improved without causing reduction in image quality due to a difference between temperature gradients when the two fixing rollers are used for thermal fixing, where the gradient of temperature distribution (temperature gradient) of each of the first fixing roller and the second fixing roller is detected, the central positions of the reciprocal shift of the first fixing roller and the second fixing roller are set such that both of the temperature gradients are cancelled, and then the first fixing roller and the second fixing roller are reciprocally shifted by a rocking section.

What is claimed is:

1. An image forming apparatus, comprising:

an image forming section configured to form an toner image depending on image data and transfer the toner image onto a recording sheet;

a first fixing roller configured to fix the toner image on the recording sheet by heat;

a first temperature sensor configured to detect temperatures of the first fixing roller at a plurality of positions in a longitudinal direction of the first fixing roller;

a second fixing roller configured to fix the toner image on the recording sheet by heat;

a second temperature sensor configured to detect temperatures of the second fixing roller at a plurality of positions in a longitudinal direction of the second fixing roller;

a rocking section configured to reciprocally shift at least one of the first fixing roller and the second fixing roller in a longitudinal direction of the at least one of the rollers; and a controller configured to obtain a first temperature gradient of the first fixing roller and a second temperature gradient of the second fixing roller based on the temperatures detected by the first temperature sensor and the second temperature sensor, set a central position of the reciprocal shift of the at least one of the rollers at a predetermined position so that the first temperature gradient and the second temperature gradient cancel each other, and then control the rocking section to reciprocally shift the at least one of the rollers.

2. The image forming apparatus of claim 1, wherein the rocking section is further configured to reciprocally shift the other roller in an longitudinal direction thereof, and the controller is further configured to set a central position of the reciprocal shift of the other roller at a predetermined position so that the first temperature gradient and the second temperature gradient cancel each other, and then control the rocking section to reciprocally shift the other roller.

3. The image forming apparatus of claim 2, wherein the controller controls the central positions of the reciprocal shift and/or amplitudes of the reciprocal shift of the first fixing roller and the second fixing roller so that the first temperature gradient and the second temperature gradient cancel each other.

4. The image forming apparatus of claim 1, wherein when the temperatures detected by the first temperature sensor and the second temperature sensor are within a predetermined range, the controller controls the rocking section to increase an amplitude of the reciprocal shift of the at least one of the rollers.

5. The image forming apparatus of claim 1, wherein the controller compares the number of processed sheets of the at least one of the rollers with the number of processed sheets of the other roller, and when the number of processed sheets of the at least one of the rollers is greater than the number of processed sheets of the other roller, the controller controls the rocking section to increase an amplitude of the reciprocal shift of the at least one of the rollers.

6. The image forming apparatus of claim 1, wherein the controller compares a remnant service life of the at least one of the rollers and a remnant service life of the other roller, and when the remnant service life of the at least one of the rollers is shorter than the remnant service life of the other roller, the controller controls the rocking section to increase an amplitude of the reciprocal shift of the at least one of the rollers.

7. A fixing device which is installed in an imager forming apparatus configured to form a toner image depending on image data and transfer the toner image onto a recording sheet, the fixing device comprising:

a first fixing roller configured to fix the toner image on the recording sheet by heat;

a first temperature sensor configured to detect temperatures of the first fixing roller at a plurality of positions in a longitudinal direction of the first fixing roller;

a second fixing roller configured to fix the toner image fixed by the first fixing roller, on the recording sheet by heat;

a second temperature sensor configured to detect temperatures of the second fixing roller at a plurality of positions in a longitudinal direction of the second fixing roller; and a rocking section configured to reciprocally shift at least one of the first fixing roller and the second fixing roller in a longitudinal direction of the at least one of the rollers, wherein a first temperature gradient of the first fixing roller and a second temperature gradient of the second fixing roller are obtained based on the temperatures detected by the first temperature sensor and the second temperature sensor, a central position of the reciprocal shift of the at least one of the rollers is set at a predetermined position so that the first temperature gradient and the second temperature gradient cancel each other, and the rocking section then reciprocally shifts the at least one of the rollers.

8. The fixing device of claim 7, wherein the rocking section is further configured to reciprocally shift the other roller in an longitudinal direction thereof, set a central position of the reciprocal shift of the other roller at a predetermined position so that the first temperature gradient and the second temperature gradient cancel each other, and then reciprocally shift the other roller.

9. The fixing device of claim 8, wherein the rocking section determines the central positions of the reciprocal shift and/or amplitudes of the reciprocal shift of the first fixing roller and the second fixing roller so that the first temperature gradient and the second temperature gradient cancel each other.

10. The fixing device of claim 7, wherein when the temperatures detected by the first temperature sensor and the second temperature sensor are within a predetermined range, the rocking section increases an amplitude the reciprocal shift of the at least one of the rollers.

11. The fixing device of claim 7, wherein when the number of processed sheets of the at least one of the rollers is greater than the number of processed sheets of the other roller, the rocking section increases an amplitude of the reciprocal shift of the at least one of the rollers.

12. The image fixing device of claim 7, wherein when the remnant service life of the at least one of the rollers is shorter than the remnant service life of the other roller, the rocking section increases an amplitude of the reciprocal shift of the at least one of the rollers.

13. An image forming system, comprising:

an image forming device configured to form an toner image depending on image data and transfer the toner image onto a recording sheet; and a fixing device, the fixing device including:

a first fixing roller configured to fix the toner image on the recording sheet by heat;

a first temperature sensor configured to detect temperatures of the first fixing roller at a plurality of positions in a longitudinal direction of the first fixing roller;

a second fixing roller configured to fix the toner image fixed by the first fixing roller, on the recording sheet by heat;

a second temperature sensor configured to detect temperatures of the second fixing roller at a plurality of positions in a longitudinal direction of the second fixing roller; and a rocking section configured to reciprocally shift at least one of the first fixing roller and the second fixing roller in a longitudinal direction of the at least one of the rollers; and wherein the fixing device obtains a first temperature gradient of the first fixing roller and a second temperature gradient of the second fixing roller based on the temperatures detected by the first temperature sensor and the second temperature sensor, and set a central position of the reciprocal shift of the at least one of the rollers at a predetermined position so that the first temperature gradient and the second temperature gradient cancel each other, and the rocking section then reciprocally shifts the at least one of the rollers.

14. The image forming system of claim 13, wherein the rocking section is further configured to reciprocally shift the other roller in an longitudinal direction thereof, and the fixing device is further configured to set a central position of the reciprocal shift of the other roller at a predetermined position so that the first temperature gradient and the second temperature gradient cancel each other, and then cause the rocking section to reciprocally shift the other roller.

15. The image forming system of claim 14, wherein the rocking section determines the central positions of the reciprocal shift and/or amplitudes of the reciprocal shift of the first fixing roller and the second fixing roller so that the first temperature gradient and the second temperature gradient cancel each other.

16. The image forming system of claim 13, wherein when the temperatures detected by the first temperature sensor and the second temperature sensor are within a predetermined range, the rocking section increases an amplitude of the at least one of the rollers.

17. The image forming system of claim 13, wherein when the number of processed sheets of the at least one of the rollers is greater than the number of processed sheets of the other roller, the rocking section increases an amplitude of the reciprocal shift of the at least one of the rollers.

18. The image forming system of claim 13, wherein when the remnant service life of the at least one of the rollers is shorter than the remnant service life of the other roller, the rocking section increases an amplitude of the reciprocal shift of the at least one of the rollers.

* * * * *